United States Patent [19]

Gruber

[11] 4,049,935

[45] Sept. 20, 1977

[54] PRESSURE SWITCH WITH DIAPHRAGM

[75] Inventor: William Paul Gruber, Altadena, Calif.

[73] Assignee: Allied Chemical Corporation, Morris Township, N.J.

[21] Appl. No.: 686,864

[22] Filed: May 17, 1976

Related U.S. Application Data

[63] Continuation of Ser. No. 478,404, June 11, 1974, which is a continuation of Ser. No. 266,880, June 28, 1972.

[51] Int. Cl.[2] ..... H01H 35/34

[52] U.S. Cl. ..... 200/83 P; 200/83 A; 280/736; 340/242; 340/52 H; 73/407 PR

[58] Field of Search ..... 200/153 W, 153 T, 83 A, 200/83 J, 83 V, 83 W, 83 R, 83 N, 83 P, 83 B; 340/240, 242, 239, 236, 237, 52 H; 280/736, 741; 180/103 A; 73/205 R, 269, 271, 407 R, 407 PR

[56] References Cited

U.S. PATENT DOCUMENTS

| | | | |
|---|---|---|---|
| 2,794,088 | 5/1957 | Ostby | 200/153 T |
| 3,109,908 | 11/1963 | Clason | 200/83 J |
| 3,760,350 | 9/1973 | Johnson | 200/83 R |
| 3,850,039 | 11/1974 | Brakebill | 280/741 |

*Primary Examiner*—Gerald P. Tolin
*Attorney, Agent, or Firm*—Jonathan Plaut; Roger H. Criss; Ernest D. Buff

[57] ABSTRACT

A pressure switch for use within a pressure chamber containing a gas having a pressure of $P_2$, said switch including a pressure vessel containing gas having a pressure of $P_1$, said vessel circumscribed by an end wall at one end thereof, side walls and closed at the second end by a flexible diaphragm, said diaphragm biased in a first position and subjected to $P_2$ on one surface thereof and to $P_1$ on the other surface thereof, said diaphragm assuming said first position when $P_2$ does not exceed $P_1$ by a predetermined amount and assuming a second position under $P_2$ when $P_2$ does exceed $P_1$ by said amount, and switch means operatively associated with movement of said diaphragm.

8 Claims, 8 Drawing Figures

PRESSURE SWITCH WITH DIAPHRAGM

This is a continuation, of application Ser. No. 478,404, filed June 11, 1974 which, in turn, is a continuation of Ser. No. 266,880, filed June 28, 1972.

BACKGROUND OF THE INVENTION

This invention relates to a diaphragm switch which is responsive to pressure of a stored gas within said switch and the differential between said pressure and the stored gas environment in which said switch is maintained and which it is monitoring.

SUMMARY OF THE INVENTION

Generally, the switch is a pressure vessel with gas stored at a first pressure ($P_1$) with a diaphragm member responsive to its own bias and that pressure to normally be maintained in one position. The switch is employed in a pressure chamber, having a gas stored therein at a second pressure $P_2$. $P_2$ is normally greater than $P_1$. When the second pressure is higher by a predetermined amount than the pressure within the pressure vessel of the switch, the diaphragm assumes a second position as a result of the pressure differential between $P_2$ and $P_1$, causing, in one embodiment, certain electrical contact structures responsive to movement of the diaphragm to effect an electrical connection and indication. If the second pressure declines so that the differential between the second pressure and the pressure in the pressure vessel is lessened below a predetermined limit or eliminated, the diaphragm under its own bias moves to its original first defined position, and a change in electrical connection and indication results.

The bias of the diaphragm makes it act in a positive displacement manner; that is, it is either in the first position where $P_2$ does not exceed $P_1$ by enough to displace the diaphragm to the second position and the bias of the diaphragm dictates its position, or the second position under the influence of $P_2$. In the preferred embodiment, the diaphragm will snap under its bias from one position to the other, although the diaphragm may move in a more linear movement. Since the switch is contained within the pressure environment in the chamber it is monitoring, any leakage from that pressure environment either into the switch pressure vessel or the outside environment will be monitored by the switch and indicated when $P_2$ falls below the predetermined minimum level. The pressure chamber may have a safety valve burstable feature to insure against too high a pressure build-up therein. Since the switch and associated pressure vessel are within the pressure chamber, with slight but unimportant variance depending on temperature, the pressure variation in accordance with temperature in the switch pressure vessel and in the outer pressure chamber will be largely the same, so that the arrangement is substantially and advantageously temperature compensated.

Further details of the invention and advantages thereof will become more apparent upon studying the following more detailed disclosure.

DETAILED DESCRIPTION OF THE INVENTION

Figure 8:
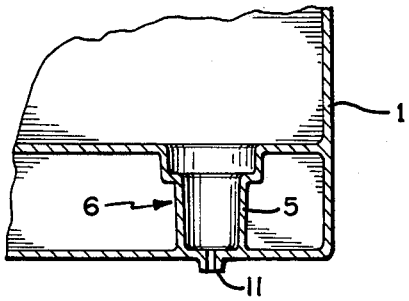

The pressure chamber 1, containing, for example, stored compressed gas such as argon at, for example, 2300 psi and shown in part and schematically, contains therein a pressure switch 2. The pressure switch 2 may be mounted within the vessel in any convenient manner, such as on pins 3, fitting into detents 4 on a side wall 5 of the switch and the vessel. Alternately, the vessel for the switch may be cast into the chamber 1, see for example FIG. 8, or otherwise provided for. The switch 2 contains a pressure vessel 6 made up, in this embodiment, of side walls 5 and end wall 7. The pressure vessel 6 may be in the form of a cylinder. The vessel 6 of this embodiment is sealed at the end opposite from the wall 7 by a diaphragm 8 mounted in a sealed relationship between opposite reinforcement sections 9 and 10 mounted in the vessel. Curvature so as to be convex with relation to end 7 of the reinforcement top section 10 is preferred in order to provide for the snap action of the diaphragm in its pre-set direction, as previously discussed. The reinforcement sections 9 and 10 are each apertured at a central portion thereof. The reinforcement section between the diaphragm and the end wall 7 is thus contained within the pressure vessel 6 and through its aperture allows stored pressurized gas within said vessel 6 to exert a force on the diaphragm. The vessel 6 may be, in one embodiment, filled with helium gas, to a pressure of, say, 2000 psi through, in one embodiment, a filling stem 11, which is cut off and brazed or otherwise closed, as at 12. Utilizing helium gas in the pressure vessel 6 has the advantage of ease of monitoring for leaks, since helium easily is monitorable by standard ion acceleration methods. A pin 13 extends through the aperture 14 in the top reinforcement section 10. The pin 13 is not sealed in the reinforcement 10, so that it may move therein and so that the force of the pressurized gas in the chamber 1 acts through the aperture on the diaphragm. With the diaphragm 8 in the position shown in FIG. 1, the pin 13 which bears thereagainst is in a position extending from the reinforcement 10 as shown. With the diaphragm in the position shown in FIG. 2, the pin is extended into the opening between the members 9 and 10.

Figure 1:
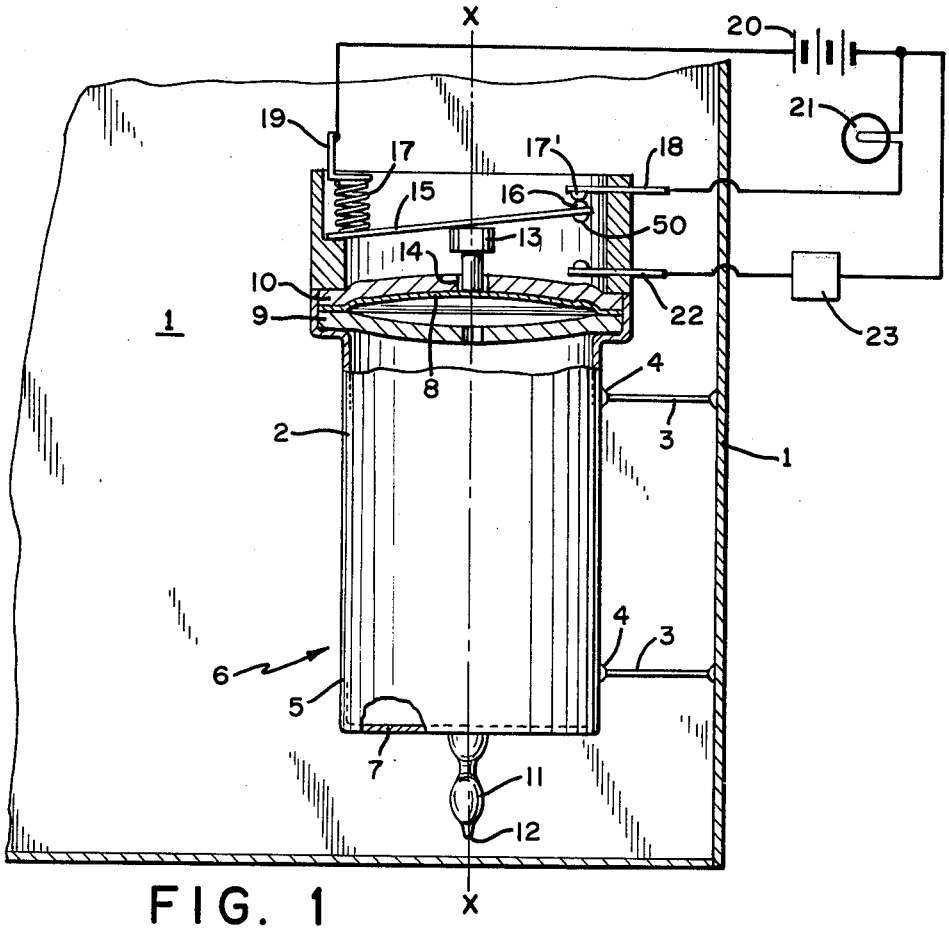
FIG. 1 shows the pressure switch inside of an outer pressure chamber.
Figure 2:
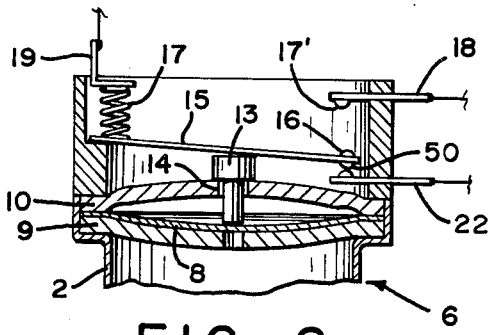
FIG. 2 shows a second position of the invention of FIG. 1.

The pin 13 bears against the contact arm 15, which is biased by spring 17 in this embodiment toward a position which extends the pin in FIG. 2 into the area between the reinforcement members 9 and 10. Movement of the pin 13 to the position shown in FIG. 1 as a result of movement of the diaphragm under its bias pushes the contact arm 15 against the action of the spring to the position shown in FIG. 1. In such position, the terminal 16 of the contact arm 15 and the terminal 17 of the terminal arm 18 make contact, in this embodiment, to complete an electrical circuit through the terminal arm 19, the spring 17 and the contact arm 15 and the terminal arm 18. In one embodiment the terminal arm 19 is electrically connected to a source of power, such as a battery 20, and the contact 18 is electrically connected to a signal device, such as a buzzer or a lamp 21, or a combination of the two, or other apparatus.

In the embodiment shown in FIGS. 1 and 2, for illustrative purposes, where the distance between the inside surface of the end 7 and the point on the central axis X—X of the surface of the section 10 behind said end is about one inch, the distance through which the diaphragm may travel from the position in FIG. 1 to the position of FIG. 2 between the reinforcing sections and on the central axis, is about 0.035 inch, with the active diameter of the diaphragm (that is the part of the diaphragm free to move) about 0.5 inch.

Figure 3:
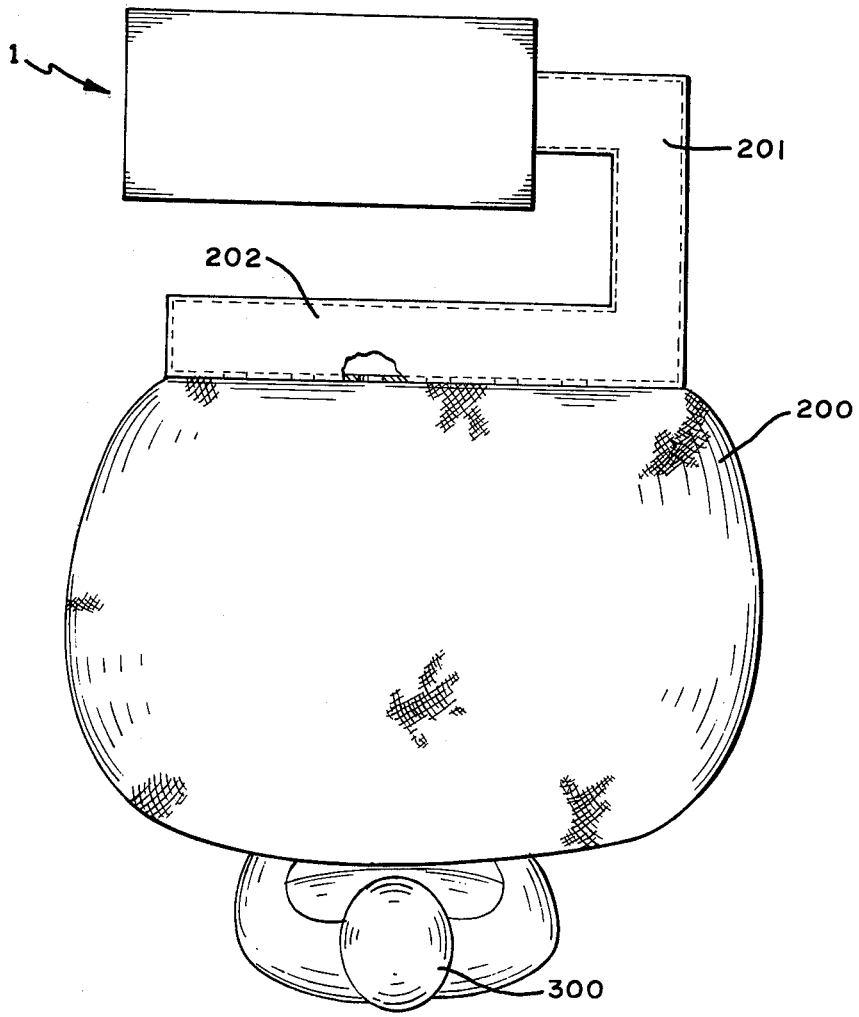
FIG. 3 shows an air bag for occupant protection inflated from the assembly disclosed.
Figure 4:
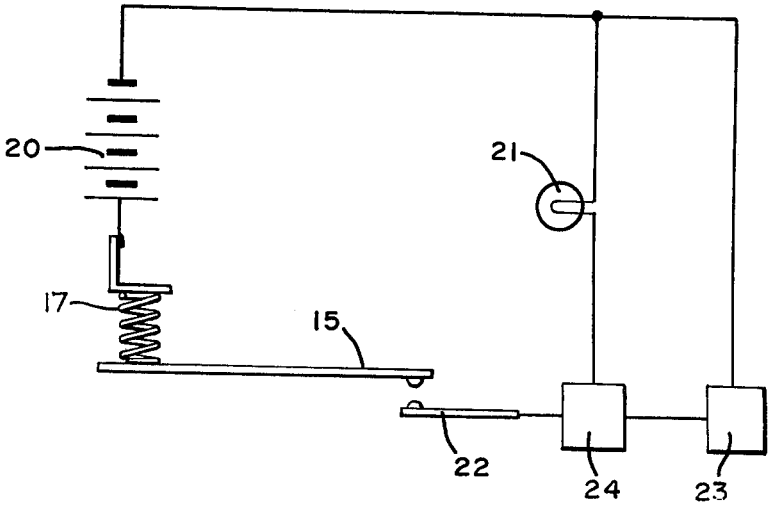
FIG. 4 shows an alternative embodiment.

When the diaphragm 8 moves to the position shown in FIG. 2, the spring 17 pushes the contact arm 15 against the pin 13 (the diaphragm having moved) so that it extends into the area between reinforcing members 9 and 10. The contact arm 15 and terminal 50 thereof make contact with the second terminal arm 22, which may be in circuit with further implementing structure, such as a sensor 23 for triggering release of gas stored in the chamber 1 through an elbow 201 and manifold 202, for example, for filling of an air cushion device 200 in a conventional manner, for protection of an automobile occupant 300, as shown schematically in FIG. 3. Alternately, as in FIG. 4, the terminal arm 18 may be dispensed with, contact being made between the terminal arm 22 and the contact arm 15, as already discussed. Implementation of the function of the unit with which the switch of this invention is employed may thus take place. However, if contact with the terminal arm 22 by the contact arm 15 does not take place (because the diaphragm is in the position shown in FIG. 1), then a logic device 24, for example, shown in schematic in FIG. 4, will energize the signal device 21.

Figure 5:
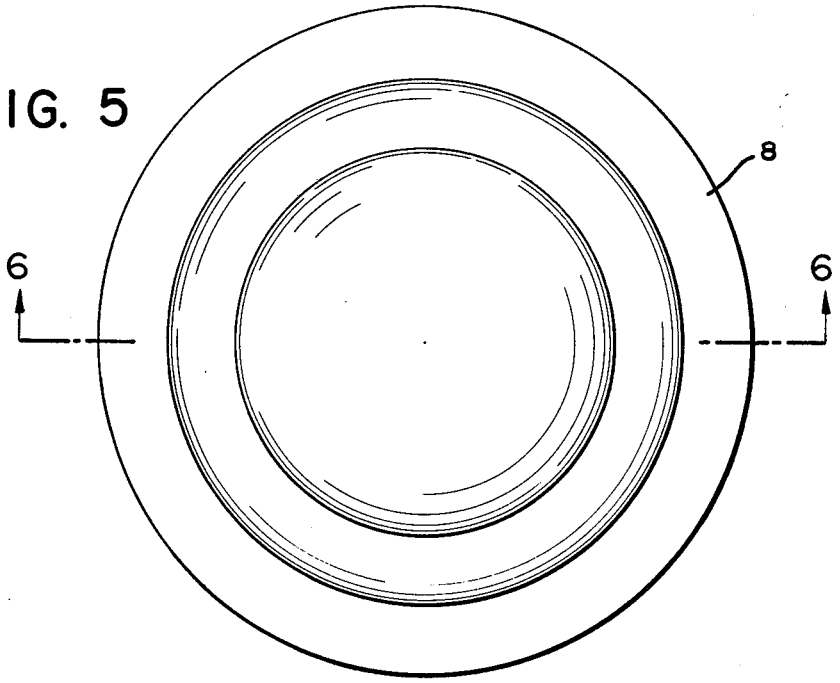
FIGS. 5 and 6 show an embodiment of the diaphragm.
Figure 6:
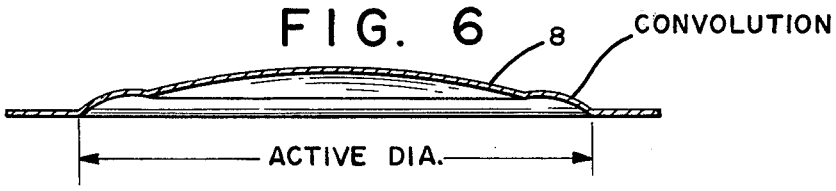

The diaphragm is preferably, although not essentially, heat treated in order to increase its strength in the face of its repeated movements, so as not to lose its bias. Preferably, the diaphragm is in pre-set convex shape, in the position of FIG. 1, with a convolution displaced from the outer line, as shown in FIGS. 5 and 6. Employment of such a convolution substantially negates the possibility of buckling in the generally smooth convex diaphragm and thus allows minimization of material to meet strength requirements.

Figure 7:
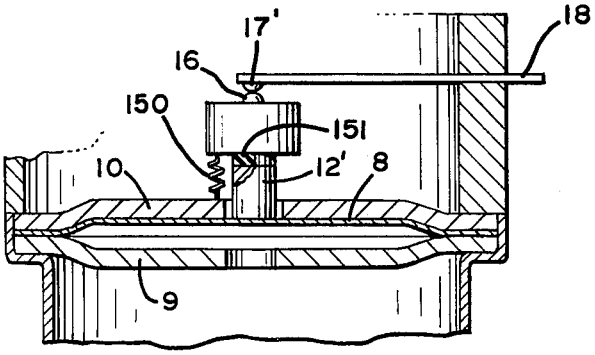
FIG. 7 shows an alternative detail, as does FIG. 8.

Alternately, terminal 19, spring 17 and associated structure may be dispensed with and the head of pin 13 of the button may be directly engageable with the terminal arm 18 when the diaphragm is in the position shown in FIG. 7 and FIG. 1. Electrical contact is then made through the head of pin 13, the terminal 18 and the warning device, etc., as described previously. The head of pin 13 must be insulated from the stem 12, as by insulation 151, and may be biased so as to be in the position shown in FIG. 2 of the drawings by tension spring 150, for example, only to extend into contact with the arm 18 through contacts 16-17' when moved to such position as a result of contact with the diaphragm. In any case, the stem 12' rides loosely in the hole of the member 10, previously described.

The pressure vessel 6 and the diaphragm 8 may be made of stainless steel or other desired material. In operation, when the pressure of the outer chamber 1 is above a predetermined minimum so that sufficient pressure differential exists between the pressure in the outer chamber 1 and the pressure in the inner switch vessel 6, the diaphragm, which is subject to said pressure differential, is in the position shown in FIG. 2 (the pin 13 in the embodiment shown being loosely fitted in the reinforcing member 10 so that the diaphragm is subjected to the pressure in the outer vessel 1, as it is communicated through the aperture 14 through which the pin 13 extends). In this diaphragm position, contact is made with terminal 22 and the unit function may be performed, such as firing of the chamber 1 to fill an air bag device.

When the pressure in the outer chamber 1 drops below the predetermined minimum limit, the differential between the pressure in the outer vessel 1, and the inner vessel 6 is lessened or substantially eliminated, and the diaphragm returns to its pre-set position, as shown in FIG. 1, under its bias. A minimum chamber pressure and a predetermined pressure differential between chamber and vessel pressure ($P_2 > P_1$) is maintained as necessary to move the diaphragm from the pre-set position of FIG. 1 to the position of FIG. 2 since the pressure in the vessel 6 is also predetermined and any leak between the chamber and the vessel will be into the vessel from the chamber as long as the chamber pressure exceeds the vessel pressure. If pressures between the chamber and vessel equalize or substantially equalize to reduce the pressure differential below the predetermined amount, the diaphragm will move under its bias to the position of FIG. 1 and, in one embodiment, energize the warning signal through the switch structure. This return to the position of FIG. 1 opens the contact between terminal arm 22 and contact arm 15, and in one embodiment closes the contact with terminal arm 18. In any event, in its application to an air cushion device for an automobile, for example, the result is that the normal functioning of the device cannot occur when the pressure in the outer chamber falls below a certain limit, and advantageously, a signal device tells the operator of the decreased pressure and the inability to perform.

I claim:

1. In a vehicle having an air cushion device for protection of an occupant in the vehicle, a pressure switch for energizing a signal device upon release of gas stored in a chamber for filling said air cushion device, said pressure switch disposed within a pressure chamber containing a gas having a pressure of $P_2$, said switch including a pressure vessel, said vessel sealed from gas communication with its surroundings, said vessel containing gas having a pressure of $P_1$, said pressure established as a result of the sealed vessel environment and the temperature of the environment, said vessel circumscribed by an end wall at one end thereof, side walls and closed at the second end by a flexible, generally convex diaphragm stable only in two positions, said diaphragm mounted in a chamber between apertured support members mounted in said switch and absent any external spring force on said diaphragm, said diaphragm biased in a preset first stable position and subjected to $P_2$ on one surface thereof and to $P_1$ on the surface thereof, said diaphragm assuming said first position under its own bias when $P_2$ does not exceed $P_1$ by a predetermined amount and snapping to the second stable position when $P_2$ does exceed $P_1$ by said amount, and switch means operatively associated with movement of said diaphragm for energizing said signal device when said diaphragm assumes said first position.

2. A switch as claimed in claim 1, said diaphragm having a convoluted shape and said switch means including a pin slideably mounted in the aperture of one of said support members and engageable with said diaphragm for movement therewith.

3. A switch as claimed in claim 2, having electrical contact means moved by said pin into at least one position which completes a signal giving circuit.

4. A switch as claimed in claim 2, said pin completing a signal giving circuit in at least one position thereof.

5. A switch as claimed in claim 1, wherein said vessel contains helium gas.

6. In a vehicle having an air cushion device for protection of an occupant in the vehicle and a pressure chamber containing a gas having a pressure of $P_2$, the improvement comprising: a pressure switch for energizing a signal device upon release of gas stored in a chamber for filling said air cushion device, said pressure switch disposed within said pressure chamber, said switch including a pressure vessel, said vessel sealed from gas communication with its surroundings, said vessel formed as an integral part of the pressure chamber and containing gas having a pressure of $P_1$, said pressure established as a result of the sealed vessel environment and the temperature of the environment, said vessel circumscribed by an end wall at one end thereof, side walls and closed at the second end by a flexible, generally convex diaphragm stable only in two positions, said diaphragm biased absent any external spring force thereon in a preset first stable position and subjected to $P_2$ on one surface thereof and to $P_1$ on the other surface thereof, said diaphragm assuming said first position under its own bias when $P_2$ does not exceed $P_1$ by a predetermined amount and snapping to a second stable position when $P_2$ does exceed $P_1$ by said amount, two apertured support members, one member disposed in either side of said diaphragm and switch means operatively associated with movement of said diaphragm for energizing said signal device when said diaphragm assumes said first position.

7. A pressure switch for energizing a signal device upon release of gas stored in a pressure chamber at a pressure of $P_2$, said switch including a pressure vessel, said vessel sealed from gas communication with its surroundings, said vessel containing gas having a pressure of $P_1$, said pressure established as a result of the sealed vessel environment and the temperature of the environment, said vessel circumscribed by an end wall at one end thereof, side walls and closed at the second end by a flexible, generally convex diaphragm stable only in two positions, said diaphragm mounted in a chamber between apertured support members mounted in said switch and absent any external spring force on said diaphragm, said diaphragm biased in a preset first stable position immediately adjacent the vessel and subjected to $P_2$ on one surface thereof and to $P_1$ on the other surface thereof, said diaphragm assuming said first position under its own bias and snapping to a second stable position moved away from said position immediately adjacent the vessel upon $P_2$ lessening a predetermined amount, and switch means operatively associated with movement of said diaphragm for energizing said signal device when said diaphragm assumes said first position.

8. A switch as claimed in claim 7, wherein said vessel contains helium gas.

* * * * *

UNITED STATES PATENT OFFICE

CERTIFICATE OF CORRECTION

Patent No. 4,049,935 Dated September 20, 1977

Inventor(s) William Paul Gruber

It is certified that error appears in the above-identified patent and that said Letters Patent are hereby corrected as shown below:

Column 4, line 53, "on the surface" should read --on the other surface--;

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*